US012765602B2

(12) United States Patent
Moon et al.

(10) Patent No.: US 12,765,602 B2
(45) Date of Patent: Oct. 20, 2026

(54) ELECTROMAGNETIC INDUCTION HEATING APPARATUS FOR HEATING AN AEROSOL-FORMING ARTICLE OF AN ELECTRONIC CIGARETTE

(71) Applicants: Silicon Mitus, Inc., Seongnam-si (KR); Silicon-Magic Semiconductor Technology (Hangzhou) Co., LTD, Hangzhou City (CN)

(72) Inventors: Jun Ho Moon, Seongnam-Si (KR); Il Kwon Chang, Goyang-Si (KR); Sung Jin Park, Seongnam-Si (KR)

(73) Assignees: Silicon Mitus, Inc., Seongnam-Si (KR); Silicon-Magic Semiconductor Technology (Hangzhou) Co., Ltd., Hangzhou City (CN)

( * ) Notice: Subject to any disclaimer, the term of this patent is extended or adjusted under 35 U.S.C. 154(b) by 836 days.

(21) Appl. No.: 18/189,856

(22) Filed: Mar. 24, 2023

(65) Prior Publication Data

US 2023/0309622 A1 Oct. 5, 2023

(30) Foreign Application Priority Data

Mar. 29, 2022 (KR) ..... 10-2022-0039121

(51) Int. Cl.
*A24F 40/465* (2020.01)
*A24F 40/57* (2020.01)
*A24F 40/90* (2020.01)

(52) U.S. Cl.
CPC ..... *A24F 40/465* (2020.01); *A24F 40/57* (2020.01); *A24F 40/90* (2020.01)

(58) Field of Classification Search
CPC ..... A24F 40/465
See application file for complete search history.

(56) References Cited

U.S. PATENT DOCUMENTS 11,160,312 B2 * 11/2021 Akao ..... A24F 40/57
2019/0274354 A1 * 9/2019 Sur ..... H05B 3/44
(Continued)

FOREIGN PATENT DOCUMENTS

KR 20200003938 A 1/2020

OTHER PUBLICATIONS

Raab, Frederick H. "Idealized Operation of the Class E Tuned Power Amplifier" IEEE Transactions on Circuits and Systems, vol. CAS-24, No. 12, Dec. 1977 pp. 725-735 (11 pages).

*Primary Examiner* — Thomas E Lazo
(74) *Attorney, Agent, or Firm* — Osha Bergman Watanabe & Burton LLP

(57) ABSTRACT

An electromagnetic induction heating apparatus for heating an aerosol-forming article of an electronic cigarette includes: a power supply unit configured to supply DC power; a power amplifier including a switch unit composed of a pair of transistor switches having a differential structure and operating by receiving the DC power from the power supply unit, and a LC resonant network composed of a resonant inductor connected to an output terminal of the switch unit and electromagnetically inductively coupled with an inductor component of a heat-generating body for heating the aerosol-forming article of the electronic cigarette and a resonant capacitor connected in parallel to the resonant inductor; and a driving unit configured to adjust an operation of the power amplifier to adjust a temperature of the heat-generating body.

9 Claims, 10 Drawing Sheets

(56) References Cited

U.S. PATENT DOCUMENTS

| | | | | |
|---|---|---|---|---|
| 2020/0128878 | A1* | 4/2020 | Stura | A24F 40/40 |
| 2020/0221775 | A1* | 7/2020 | Mironov | A24F 40/465 |
| 2021/0127754 | A1* | 5/2021 | Tatsuta | A24F 40/90 |
| 2021/0145071 | A1* | 5/2021 | Butin | A24F 40/50 |
| 2021/0159732 | A1* | 5/2021 | Czimmek | H02J 50/12 |
| 2021/0186109 | A1* | 6/2021 | Milligan | H05B 6/108 |
| 2021/0204612 | A1* | 7/2021 | Korus | H05B 1/0297 |

* cited by examiner

ELECTROMAGNETIC INDUCTION HEATING APPARATUS FOR HEATING AN AEROSOL-FORMING ARTICLE OF AN ELECTRONIC CIGARETTE

CROSS-REFERENCE TO RELATED APPLICATION

This application claims priority to Korean Patent Application No. 10-2022-0039121 filed on Mar. 29, 2022 and all the benefits accruing therefrom under 35 U.S.C. § 119, the contents of which are incorporated by reference in their entirety.

BACKGROUND

The present disclosure relates to an electromagnetic induction heating apparatus for heating an aerosol-forming article of an electronic cigarette using a heat-generating body. More specifically, the present disclosure relates to an electromagnetic induction heating apparatus for heating an aerosol-forming article of an electronic cigarette, which can maximize a power utilization factor in a process of heating the aerosol-forming article of the electronic cigarette using the heat-generating body, can reduce the implementation and manufacturing difficulty of the apparatus, and can adaptively control a heating temperature of the heat-generating body.

Conventionally, electronic apparatuses using aerosol-forming tobacco-containing articles to replace cigarettes are known.

One conventional method for aerosol formation relates to a resistive heat generation induction method of inducing resistive heat generation using a heatable metal heat-generating body and heating the aerosol-forming article to a temperature at which volatile components can be released by directly contacting the aerosol-forming article with the metal heat-generating body. According to the resistive heat generation induction method, the metal heat-generating body may be implemented to have various shapes by using metal objects such as a heating blade, a heating spear, and a heating can.

Another conventional method for aerosol formation relates to an electromagnetic inductive heating method using heat generation characteristics corresponding to power loss by generating eddy currents in order to increase the temperature of the heatable metal heat-generating body. According to this electromagnetic inductive heating method, an AC magnetic field is generated in an LC-type resonant network including an inductor to raise the temperature of the metal heat-generating body, and the aerosol-forming article in contact with the metal heat-generating body is heated to the temperature at which volatile components are released. In this case, the metal heat-generating body may be implemented to have various shapes by using a metal component, similar to the resistive heat-generating body.

According to the resistive heat generation induction method, the heat-generating body should physically contact the electronic apparatus whereas, according to the electromagnetic inductive heating method, the heat-generating body can be heated even if the heat-generating body is physically in contact with or not in contact with the electronic apparatus.

The electromagnetic inductive heating method as described above can quickly raise the heat-generating body to a target temperature compared to the resistive heat generation induction method, and can provide users with high usability when using limited power through a relatively high power utilization factor.

Hereinafter, conventional electromagnetic inductive heating technology will be described by citing Korean unexamined patent application publication No. 10-2020-0003938, which discloses an electromagnetic induction heating technology.

FIG. 1 is a diagram illustrating a class-E power amplifier structure published in Korean unexamined patent application publication No. 10-2020-0003938.

Referring to FIG. 1, Korean unexamined patent application publication No. 10-2020-0003938 uses an amplifier power with class-E structure for the rapidity of heating and the formation of a small-sized apparatus. Since the class-E power amplifier includes an LC load network that includes a series connection form of an inductor and capacitor and operates with only a single switch, the class-E power amplifier is suitable for the formation of a small-sized apparatus. In addition, since the class-E power amplifier is a power amplifier that operates in a switch mode, it is suitable for electromagnetic induction heating compared to other linear mode power amplifiers and is thus effective in forming aerosol by rapidly heating a heat-generating body.

However, the class-E power amplifier has a very high drain-to-source peak voltage across the switch (reference numeral 1320 in FIG. 1) due to the structure and operation characteristics thereof, and thus a switch element with a high breakdown voltage is necessarily required. This will act as a very large barrier to restrictions on the use of parts and increase in unit cost in implementing the device.

In addition, since the class-E power amplifier has peak-shaped current waveform characteristics along with the high drain-source peak voltage, it has a disadvantage of lowering a power utilization factor of the power amplifier.

As detailed in a paper ("Idealized Operation of the Class E Tuned Power Amplifier", F. H. Raab) published in IEEE Transactions on Circuits and Systems, December 1977, vol. CAS-24, NO.:12, pages 725-735, the power utilization factor of the class-E power amplifier is very low at approximately 0.0981, which can be attributed to numerical values of a high peak voltage of approximately 3.56 and high peak current of approximately 2.86 applied to the switch.

As described above, the electromagnetic induction heating apparatus using the class-E power amplifier requires a user to repeat a charging process, especially in an application field (e-cigarette in a narrow sense) that uses a limited voltage and current source (battery or capacitor).

In addition, as described above, since the electromagnetic induction heating apparatus using the class-E power amplifier requires a switch having) a breakdown voltage several times higher than (normally approximately 3.56 times, as high as approximately 7 times) the voltage source used to ensure stable operation of the apparatus, there is difficulty in implementing the apparatus.

PRIOR ART LITERATURE

Patent Literature (PTL 1) Korean unexamined patent application publication No. 10-2020-0003938 (published date: Jan. 10, 2020, Title: Induction heating device for heating aerosol-forming base material)

SUMMARY

The present disclosure provides an electromagnetic induction heating apparatus for heating an aerosol-forming article of an electronic cigarette, which can maximize a power utilization factor in a process of heating the aerosol-forming article of the electronic cigarette using a heat-generating body, can reduce the implementation and manufacturing difficulty of the apparatus, and can adaptively control a heating temperature of the heat-generating body.

In accordance with one or more embodiments of the present disclosure, an electromagnetic induction heating apparatus for heating an aerosol-forming article of an electronic cigarette includes a power supply unit configured to supply DC power, a power amplifier including a switch unit composed of a pair of transistor switches having a differential structure and operating by receiving the DC power from the power supply unit and a LC resonant network composed of a resonant inductor connected to an output terminal of the switch unit and electromagnetically inductively coupled with an inductor component of a heat-generating body for heating the aerosol-forming article of the electronic cigarette and a resonant capacitor connected in parallel to the resonant inductor, and a driving unit configured to adjust an operation of the power amplifier to adjust a temperature of the heat-generating body.

In the electromagnetic induction heating apparatus for heating the aerosol-forming article of the electronic cigarette, the power amplifier may be a current mode class-D power amplifier, and the switch unit constituting the power amplifier may be configured to induce resonance of the LC resonant network to transfer power to the heat-generating body.

In the electromagnetic induction heating apparatus for heating the aerosol-forming article of the electronic cigarette, the power amplifier may further include a first choke inductor installed between a drain of a first transistor switch constituting the switch unit and the power supply unit and a second choke inductor installed between a drain of a second transistor switch constituting the switch unit and the power supply unit, and the LC resonant network may be connected to the drain of the first transistor switch and the drain of the second transistor switch.

In the electromagnetic induction heating apparatus for heating the aerosol-forming article of the electronic cigarette, the driving unit may be configured to estimate a change in temperature of the heat-generating body by calculating a change in resistance value of the heat-generating body according to a voltage of the LC resonant network, and control the operation of the power amplifier according to the estimated change in temperature.

In the electromagnetic induction heating apparatus for heating the aerosol-forming article of the electronic cigarette, the driving unit may include a sensing circuit configured to sense a voltage of the LC resonant network, an MCU configured to estimate a change in temperature of the heat-generating body by calculating a change in resistance value of the heat-generating body according to the voltage of the LC resonant network sensed by the sensing circuit and generate a heat-generating body temperature control signal for controlling a temperature of the heat-generating body according to the estimated change in temperature of the heat-generating body, and a switch driver configured to generate a switch driving signal for differentially driving the pair of transistor switches constituting the switch unit according to the heat-generating body temperature control signal received from the MCU.

In the electromagnetic induction heating apparatus for heating the aerosol-forming article of the electronic cigarette, the driving unit may be configured to calculate a change in resistance value of the heat-generating body according to a current used by the power amplifier and control the operation of the power amplifier according to the calculated change in resistance value.

In the electromagnetic induction heating apparatus for heating the aerosol-forming article of the electronic cigarette, the driving unit may include a sensing circuit configured to sense a current used by the power amplifier, an MCU configured to calculate a change in resistance value of the heat-generating body according to the current used by the power amplifier sensed by the sensing circuit and generate a heat-generating body temperature control signal for controlling a temperature of the heat-generating body according to the calculated change in resistance value of the heat-generating body, and a switch driver configured to generate a switch driving signal for differentially driving the pair of transistor switches constituting the switch unit according to the heat-generating body temperature control signal received from the MCU.

In the electromagnetic induction heating apparatus for heating the aerosol-forming article of the electronic cigarette, an operating frequency of the pair of transistor switches constituting the switch unit may be approximately 0.1 MHz to approximately 27.283 MHz.

In the electromagnetic induction heating apparatus for heating the aerosol-forming article of the electronic cigarette, the power supply unit may include a rechargeable DC battery.

BRIEF DESCRIPTION OF THE DRAWINGS

Exemplary embodiments can be understood in more detail from the following description taken in conjunction with the accompanying drawings, in which.

DETAILED DESCRIPTION

Figure 1:
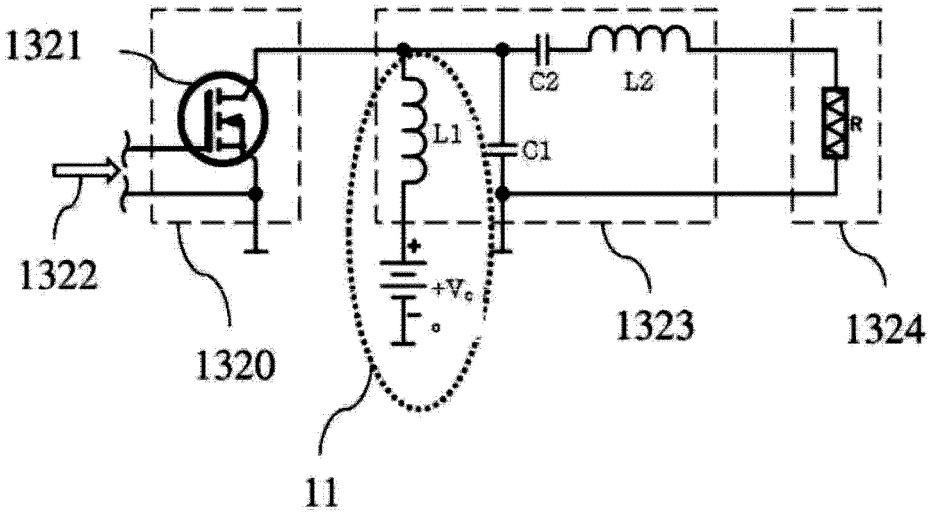
PRIOR ART FIG. 1
FIG. 1 is a diagram illustrating the structure of a class-E power amplifier published in the prior art.

Specific structural or functional descriptions of embodiments according to the concept of the present invention disclosed in this specification are only illustrated for the purpose of explaining the embodiments according to the concept of the present invention, and the embodiments according to the concept of the present invention may be embodied in various forms and should not be construed as limited to the embodiments set forth herein. Rather, these embodiments are provided so that this disclosure will be thorough and complete, and will fully convey the scope of the present invention to those skilled in the art.

Various modifications may be made to the embodiments according to the concept of the present invention and the embodiments can have various forms, and thus the embodiments are illustrated in the drawings and described in detail in this specification. However, this is not intended to limit the embodiments according to the concept of the present invention to specific disclosure forms, and includes all modifications, equivalents, or substitutes included in the spirit and technical scope of the present invention.

Unless otherwise defined, all terms used herein, including technical or scientific terms, have the same meaning as commonly understood by one of ordinary skill in the art to which the present invention belongs. Terms such as those defined in commonly used dictionaries should be interpreted as having a meaning consistent with the meaning in the context of the prior art, and should not be interpreted in an ideal or excessively formal meaning unless explicitly defined in the present application.

Hereinafter, one or more embodiments of the present disclosure will be described in detail with reference to the accompanying drawings.

Figure 2:
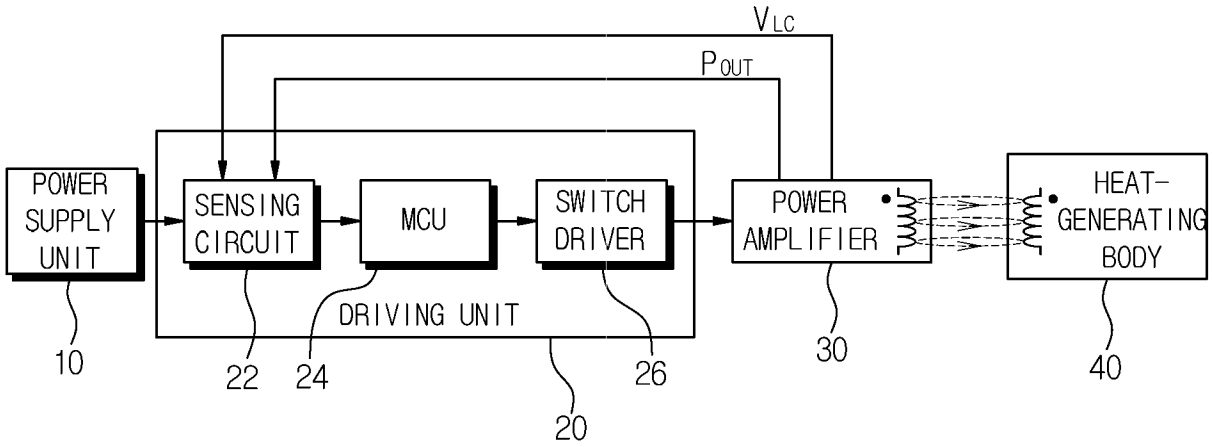
FIG. 2 is a block diagram conceptually illustrating an electromagnetic induction heating apparatus for heating an aerosol-forming article of an electronic cigarette in accordance with one or more embodiments of the present disclosure.
Figure 3:
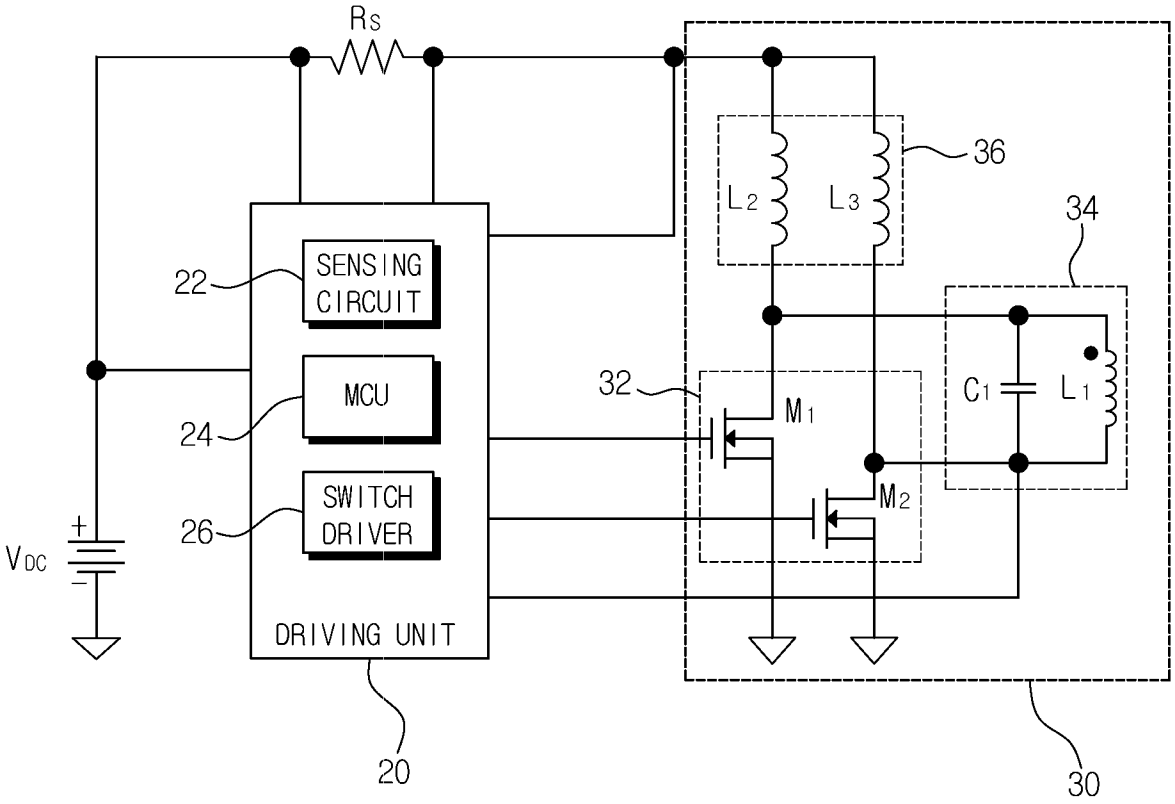
FIG. 3 is a circuit diagram of the electromagnetic induction heating apparatus for heating the aerosol-forming article of the electronic cigarette in accordance with one or more embodiments of the present disclosure.
Figure 4:
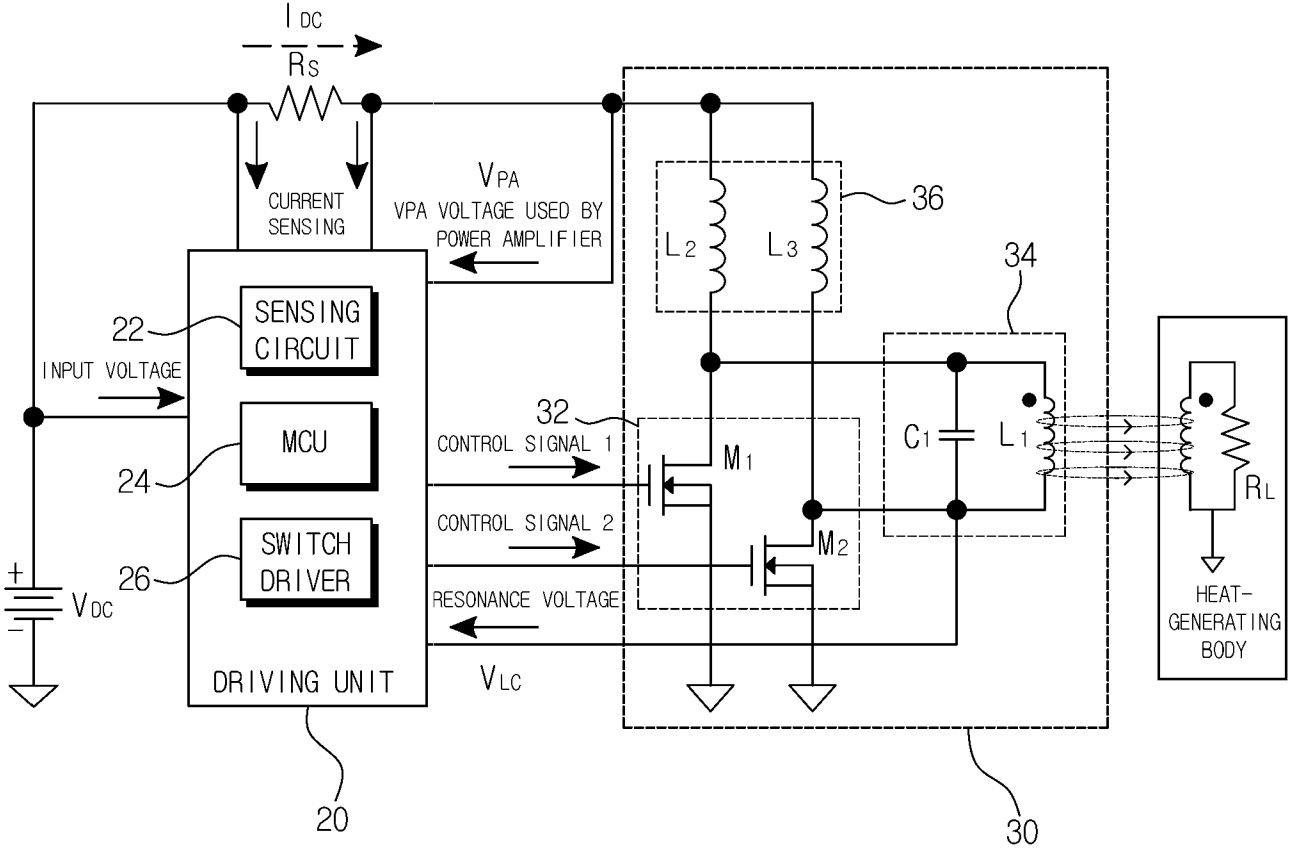
FIG. 4 is a diagram illustrating an example in which a heat-generating body is included in one or more embodiments of the present disclosure.
Figure 5:
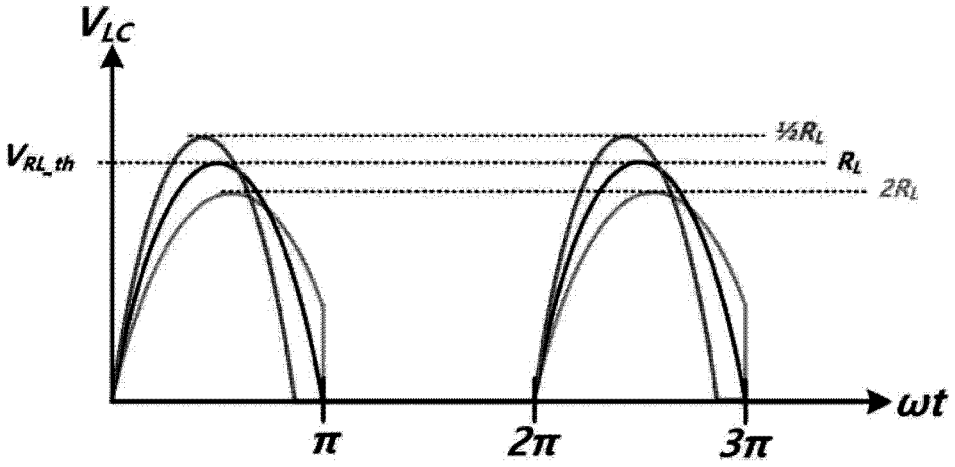
FIG. 5 is a diagram illustrating an LC resonance voltage signal that changes according to a change in load resistance of the heat-generating body in one or more embodiments of the present disclosure.

FIG. 2 is a block diagram conceptually illustrating an electromagnetic induction heating apparatus for heating an aerosol-forming article of an electronic cigarette in accordance with one or more embodiments of the present disclosure, FIG. 3 is a circuit diagram of the electromagnetic induction heating apparatus for heating the aerosol-forming article of the electronic cigarette in accordance with one or more embodiments of the present disclosure, FIG. 4 is a diagram illustrating a non-limiting example in which a heat-generating body is included in one or more embodiments of the present disclosure, and FIG. 5 is a diagram illustrating an LC resonance voltage signal that changes according to a change in load resistance of a heat-generating body in one or more embodiments of the present disclosure.

Referring to FIGS. 2 to 5, the electromagnetic induction heating apparatus for heating the aerosol-forming article of the electronic cigarette according to one or more embodiments of the present disclosure is configured to include a power supply unit 10, a driving unit 20, and a power amplifier 30.

The power supply unit 10 is a component that supplies DC power, and for example, the power supply unit 10 may be configured to include a rechargeable DC battery.

The power amplifier 30 may be configured to include a switch unit 32, an LC resonant network 34, and a choke inductor unit 36.

The switch unit 32 operates by receiving DC power from the power supply unit 10 and is composed of a pair of transistor switches M1 and M2 having a differential structure.

For example, the pair of transistor switches M1 and M2 constituting the switch unit 32 may be metal oxide semiconductor field effect transistors (MOSFETs).

In addition, the power amplifier 30 is a current mode class-D power amplifier, and the switch unit 32 constituting the power amplifier may be configured to induce resonance of the LC resonant network 34 to transfer power to a heat-generating body 40.

The LC resonant network 34 is connected to an output terminal of the switch unit 32 and is composed of a resonant inductor L1 electromagnetically inductively coupled to an inductor component of the heat-generating body 40 for heating the aerosol-forming article of the electronic cigarette, and a resonant capacitor C1 connected in parallel to the resonant inductor L1.

For example, when the switch unit 32 is composed of two MOSFET elements coupled in a differential operation structure, the LC resonant network 34 may be electrically connected to a drain of the first transistor switch M1 and a drain of the second transistor switch M2.

The choke inductor unit 36 may be configured to include a first choke inductor L2 installed between the drain of the first transistor switch M1 constituting the switch unit 32 and the power supply unit 10 and a second choke inductor L3 installed between the drain of the two-transistor switch M2 constituting the switch unit 32 and the power supply unit 10.

The driving unit 20 is a component that controls an operation of the power amplifier 30 to adjust a temperature of the heat-generating body 40.

In one or more embodiments, the driving unit 20 may be configured to estimate a change in temperature of the heat-generating body 40 by calculating a change in resistance value of the heat-generating body according to a voltage of the LC resonant network 34 and to control the operation of the power amplifier 30 according to the estimated change in temperature.

As a specific configuration for this, the driving unit 20 may be configured to include a sensing circuit 22, a main control unit (MCU) 24, and a switch driver 26.

The sensing circuit 22 senses the voltage of the LC resonant network 34 and transfers the voltage to the MCU 24.

The MCU 24 estimates the change in temperature of the heat-generating body 40 by calculating the change in resistance value of the heat-generating body 40 according to the voltage of the LC resonant network 34 sensed by the sensing circuit 22, and generates a heat-generating body temperature control signal for controlling the temperature of the heat-generating body 40 according to the estimated change in temperature of the heat-generating body 40 and transfers the heat-generating body temperature control signal to the switch driver 26.

The switch driver 26 generates a switch driving signal for differentially driving the first transistor switch M1 and the second transistor switch M2 constituting the switch unit 32 according to the heat-generating body temperature control signal received from the MCU 24 and transfers the switch driving signal to gates of the first transistor switch M1 and the second transistor switch M2.

In one or more embodiments, the driving unit 20 may be configured to calculate a change in the resistance value of the heat-generating body 40 according to the current used by the power amplifier 30 and to control the operation of the power amplifier 30 according to the calculated change in resistance value.

As a specific configuration for this, the driving unit 20 may be configured to include the sensing circuit 22, the MCU 24, and the switch driver 26.

The sensing circuit 22 senses the current used by the power amplifier 30 and transfers the sensed current used by the power amplifier 30 to the MCU 24.

The MCU 24 calculates the change in the resistance value of the heat-generating body 40 according to the current used by the power amplifier 30 sensed by the sensing circuit 22, generates a heat-generating body temperature control signal for controlling the temperature of the heat-generating body 40 according to the calculated change in the resistance value of the heat-generating body 40, and transfers the heat-generating body temperature control signal to the switch driver 26.

The switch driver 26 generates a switch driving signal for differentially driving the first transistor switch M1 and the second transistor switch M2 constituting the switch unit 32 according to the heat-generating body temperature control signal received from the MCU 24, and transfers the switch driving signal to the gates of the first transistor switch M1 and the second transistor switch M2.

In one or more embodiments, the pair of transistor switches M1 and M2 constituting the switch unit 32 can operate up to several GHz, but the pair of transistor switches M1 and M2 may be configured such that an operating frequency thereof is adjusted in the range of approximately 0.1 MHz to approximately 27.283 MHz in consideration of the purpose of the device and physical components.

In one or more embodiments, the driving unit 20 for implementing a method for sensing a temperature of the heat-generating body 40 and adjusting the temperature is preferably implemented in the form of a single silicon chip or a single package in order to minimize a volume of an electronic smoking apparatus. However, the drive unit 20 is not limited thereto, and may be configured by combining the components thereof into a single part.

Hereinafter, the present disclosure will be described more specifically and exemplarily by further referring to FIGS. 6 to 10.

Figure 6:
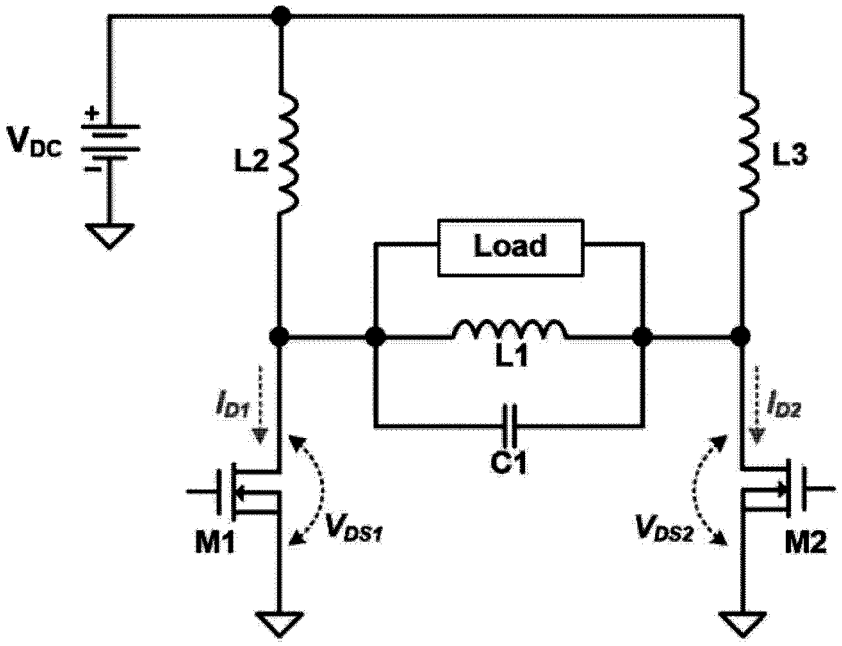
FIG. 6 is a diagram for describing an operation of a current mode class-D power amplifier applied to one or more embodiments of the present disclosure.
Figure 7:
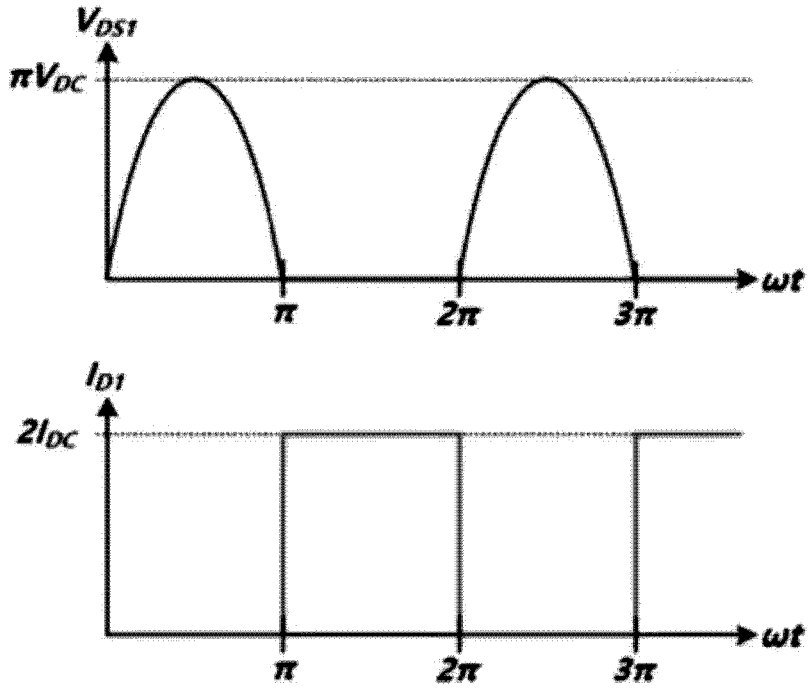
FIGS. 7 and 8 are diagrams illustrating the maximum drain-source peak voltage and current applied during on/off operation of a pair of transistor switches M1 and M2 constituting the current mode class-D power amplifier.
Figure 8:
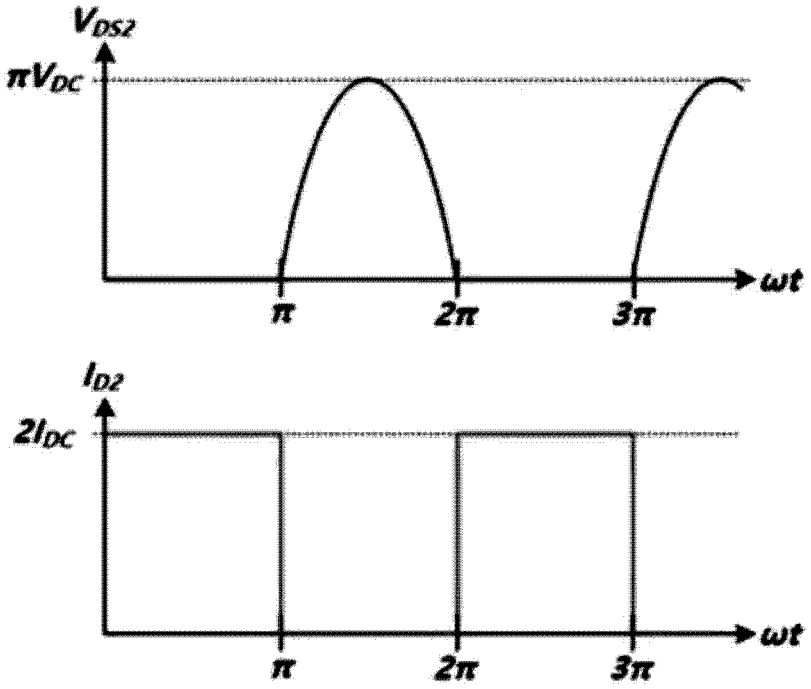

FIG. 6 is a diagram for describing an operation of a current mode class-D power amplifier applied to one or more embodiments of the present disclosure, and FIGS. 7 and 8 are diagrams illustrating the maximum drain-source peak voltage and current applied during on/off operation of a pair of transistor switches M1 and M2 constituting the current mode class-D power amplifier.

Referring further to FIGS. 6 to 8, the electromagnetic induction heating apparatus for the purpose of heating the aerosol-forming article embodied in the present invention includes the current mode class-D power amplifier. This power amplifier is configured with the pair of transistor switches M1 and M2, a pair of choke inductors L2 and L3, and an LC resonant network of L1 and C1.

The current mode class-D power amplifier is very advantageous in implementing the electronic smoking apparatus that needs to implement a small-sized apparatus and use limited power.

As illustrated in FIG. 6, drain-source peak voltages VDS1 and VDS2 applied to the pair of transistor switches M1 and M2, respectively, of an amplifier operating in differential form can be represented by Equations 1 and 2.

$$V_{DC} = \frac{1}{2\pi}\int_0^{\pi} V_{DS_peak}\sin(\omega t)d\omega t = \frac{1}{\pi}V_{DS_peak} \quad \text{[Equation 1]}$$

-continued $$V_{DS_peak} = \pi V_{DC} \quad \text{[Equation 2]}$$

In this case, due to the structural characteristics of the power amplifier in which the LC resonant network and the load are connected in parallel, harmonic components are short-circuited and only the fundamental resonant frequency is applied to the load, and thus the current applied to the transistor has a square wave form, and drain peak currents $I_{D1}$ and $I_{D2}$ at this time can be represented by Equation 3, Equation 4, and Equation 5 below.

$$I_D(\omega t) = I_{DC} \times sq(\omega t) \quad \text{[Equation 3]}$$

$$sq(\omega t) = \frac{4}{\pi}\left[\sum_{n=1,3,5,\ldots}^{\infty} \frac{1}{n}\sin(n\omega t)\right] \quad \text{[Equation 4]}$$

$$I_{D_peak} = 2I_{DC} \quad \text{[Equation 5]}$$

Referring to Equation 4, sq(ωt) means a square wave including an infinite number of Fourier coefficients, and $I_D(\omega t)$ has a maximum current value as expressed in Equation 5 due to the on/off operation of transistors M1 and M2.

The maximum drain-source peak voltage and current applied during on/off operation of the pair of transistor switches M1 and M2 defined by Equations 2 and 5 can be plotted as shown in FIGS. 7 and 8, respectively.

As described earlier, compared to the high drain-source peak voltage applied to the transistor switch (approximately 3.56 times that of the voltage source) and the current waveform characteristics in the form of a peak, which are characteristics of the class-E structure power amplifier of the prior art, the current mode class-D power amplifier has a relatively low drain-to-peak voltage and current waveform characteristics in the form of the square wave limited to twice or less the $I_{DC}$. Such characteristics may provide a wider range of options in selecting the use of transistors in forming a targeted apparatus and help to lower manufacturing cost.

Figure 9:
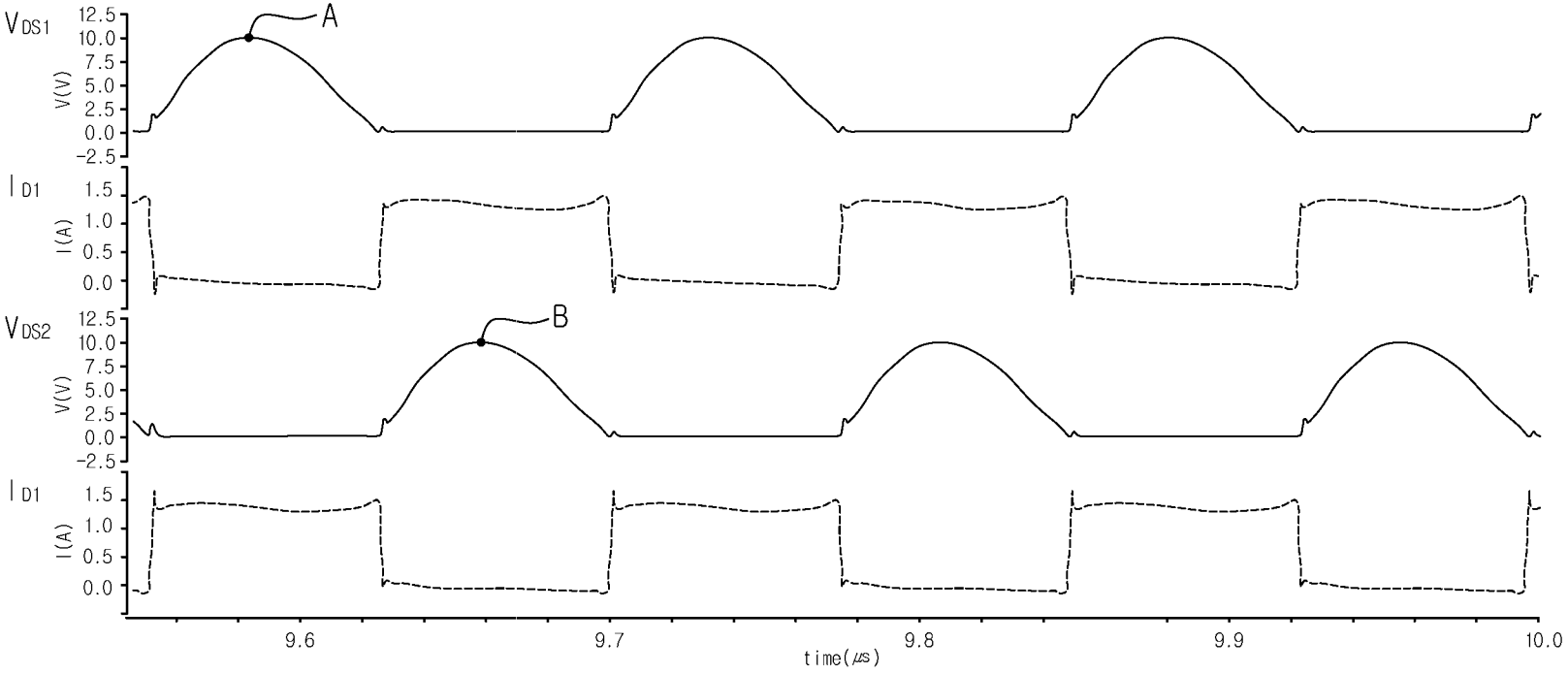
FIG. 9 is a diagram illustrating simulation results of drain-source peak voltage and current characteristics during operation of the current mode class-D power amplifier.

FIG. 9 is a diagram illustrating simulation results of the drain-source peak voltage and current characteristics during operation of the current mode class-D power amplifier.

In the simulation illustrated in FIG. 9, the operating frequency of the transistor switch is approximately 6.78 MHz, the voltage of the voltage source VDC is approximately 3.2 V, and the load resistance is approximately 1Ω.

Through this simulation result, it can be seen that the maximum peak voltages $V_{DS1}$ and $V_{DS2}$ applied to the first and second transistor switches M1 and M2, respectively, are approximately 10.1 V when VDC is approximately 3.2 V, which is very close to the value of approximately 10.05 V which can be obtained through Equation 2. In addition, it can be seen that the current waveform in the form of the square wave, which is limited to twice or less the $I_{DC}$, flows through the transistor. In FIG. 9, the measured values of the peak point A are approximately 9.583271 μs and approximately 10.10566 V and the measured values of the peak point B are approximately 9.658514 μs and approximately 10.11498 V.

Through the equations and simulation verification described above, the power utilization factor of the current mode class-D power amplifier can be calculated through Equation 6.

$$P_{max} = \frac{P_{out}}{V_{DS_peak} \times I_{D_peak}} \quad \text{[Equation 6]}$$

In this case, $P_{max}$ is the maximum power utilization factor, and $P_{out}$ is output power of the power amplifier. The output power of the power amplifier operating in a differential structure is as expressed in Equation 7, where $V_{F1}$ and $I_{F1}$ represent fundamental frequency components of the Fourier series of the voltage and the current, respectively.

$$P_{out} = \frac{1}{2} \times V_{F1} \times I_{F1} \quad \text{[Equation 7]}$$

As shown in the simulation results, $V_{F1}$ having a voltage characteristic in the form of a sine wave and $I_{F1}$ having a characteristic in the form of a square wave can be defined as in Equation 8.

$$V_{F1} = \frac{\pi}{2} \times V_{DC}, \quad I_{F1} = \frac{4}{\pi} \times I_{DC} \quad \text{[Equation 8]}$$

As a result, Equation 7 is expressed as Equation 9 by Equation 8, and when applied to Equation 6 for the maximum power utilization factor, it is simplified to Equation 10.

$$P_{out} = 2 \times V_{DC} \times I_{DC} = \frac{V_{DS_peak} \times I_{D_peak}}{\pi}, \quad \left(V_{DS_{peak}} = V_{diff} = 2 \times V_{F1}\right) \quad \text{[Equation 9]}$$

$$P_{max} = \frac{1}{\pi} \quad \text{[Equation 10]}$$

That is, since the maximum power utilization factor of the current mode class-D power amplifier is approximately 0.32, which shows a characteristic that is approximately 3.24 times higher than the power utilization factor of approximately 0.0981 of the class-E power amplifier, it provides a higher degree of convenience to a user in an application field that uses limited power (e-cigarettes in a narrow sense).

Meanwhile, as described earlier, the electromagnetic induction heating apparatus for heating the aerosol-forming article according to one or more embodiments of the present disclosure includes the driving unit 20 including the MCU 24. The MCU 24 is programmed to estimate the change in temperature of the heat-generating body 40 by sensing input power of the power supply unit 10 which is a DC voltage source, output power of the power amplifier 30, and the voltage of the LC resonant network 34. And the MCU 24 determines whether or not the power amplifier 30 operates. This means that even if the heat-generating body 40 is in a non-contact state with the electromagnetic induction heating apparatus for heating the aerosol-forming article according to one or more embodiments of the present disclosure, whether or not the power amplifier 30 operates can be determined by estimating the change in temperature. As described in more detail below, the current mode class-D power amplifier can actively determine whether or not to operate in response to the change in temperature of the heat-generating body 40 including a certain level of load resistance of interest to the user.

The inductance of the inductor L1 and capacitance of the capacitor C1 used in the parallel resonant network of the current mode class-D power amplifier may be selected by the operating frequency and the load resistance value. $Q_{LC}$ in Equation 11 below is a quality factor of the resonant circuit and is a value selectable by the user. In a state where a transistor switching frequency is fixed to one of the operating frequencies used in the present invention, the inductance of the inductor L1 and the capacitance of capacitor C1 can be selected according to Equation 12 by a specific load resistance value $R_L$.

$$Q_{LC} = 2\pi f \times R_L \times C_1 \quad \text{[Equation 11]}$$

$$C_1 = \frac{Q_{LC}}{2\pi f \times R_L}, \quad L_1 = \frac{1}{(2\pi f)^2 \times C_1} \quad \text{[Equation 12]}$$

However, in the case of the current mode class-D power amplifier, since the LC resonant network 34 is located in parallel with a load resistor, it is necessary to consider the $C_{DS1}$ and $C_{DS2}$ (drain-source capacitance) components of the transistor switches M1 and M2 when selecting the capacitance of the resonant capacitor C1, which can be reflected by an experimental value.

The power amplifier 30, which includes the LC resonant network 34 having the inductance of the inductor L1 and the capacitance of the capacitor C1 selected for the purpose of heating the heat-generating body 40 having a specific load resistance value $R_L$, needs to sense the temperature of the heat-generating body 40 to determine the operating range. In the case of an apparatus manufactured with a heat-generating body in contact with an induction heating apparatus, change in temperature can be intuitively sensed using an apparatus for temperature sensing, e.g., a negative temperature coefficient (NTC) thermistor or a positive temperature coefficient (PTC) and a thermocouple device, i.e., a thermocouple, etc.

However, in the case of a heat-generating body configured in a non-contact form with the induction heating apparatus, since it is not possible to use the contact type temperature sensing apparatus described above, a method of estimating an apparent resistance value by sensing a current used by the power amplifier 30 and a change amount thereof may also be used in order to sense an increase and change in the temperature of the heat-generating body. For example, an eddy current generated by an initial operation of the power amplifier 30 will continuously increase the temperature of the heat-generating body 40. The resistance value of the heat-generating body 40, which is typically implemented with a metal component, increases as the temperature thereof rises, and the resistance value increases up to the temperature (Curie temperature or Curie point) at which electromagnetic induction is no longer caused by the eddy current. The current used by the power amplifier 30 decreases in response to the increase in the resistance value generated at this time, and the MCU 24 may calculate the change amount thereof through the sensing circuit 22 to calculate the apparent resistance value of the heat-generating body 40.

Another example for sensing the temperature of the heat-generating body configured in a non-contact form with the induction heating apparatus is sensing a change in temperature through the change in the resistance value of the heat-generating body 40 by sensing a voltage $V_{LC}$ of the LC resonant network 34. As shown in FIG. 5, the voltage $V_{LC}$ of the LC resonant network 34 of the current mode class-D power amplifier operating at a fixed frequency shows a constant peak voltage characteristic corresponding to a specific load resistance. This constant peak voltage characteristic is only dependent on the change in resistance value of the heat-generating body 40 if the capacity and operating frequency of the LC resonant network 34 are fixed. Referring to the temperature change characteristics of the metal component heat-generating body described above, it is clear that, compared to the voltage $V_{LC}$ of the LC resonant network 34 during initial operation of the power amplifier 30, the resistance value increases as the temperature of the heat-generating body 40 and $V_{LC}$ decreases as the resistance value increases. Similarly, the change amount of $V_{LC}$ is transferred to the MCU 24, which is programmed, through the sensing circuit 22, and it is possible to determine, by calculating the change amount of $V_{LC}$, whether or not the switch driver 26 operates in order to respond to the change in temperature of the heat-generating body 40. That is, a configuration may be made such that the sensing circuit 22 senses the voltage $V_{LC}$ of the LC resonant network 34 and transfers the voltage $V_{LC}$ to the MCU 24, the MCU 24 estimates the change in temperature of the heat-generating body 40 by calculating the change in resistance value of the heat-generating body 40 according to the voltage $V_{LC}$ of the LC resonant network 34 sensed by the sensing circuit 22 and generates a heat-generating body temperature control signal for controlling the temperature of the heat-generating body 40 and transmits the heat-generating body temperature control signal to the switch driver 26, and the switch driver 26 generates a switch driving signal for differentially driving the pair of transistor switches M1 and M2 constituting the switch unit 32 according to the heat-generating body temperature control signal transferred from the MCU 24.

Figure 10:
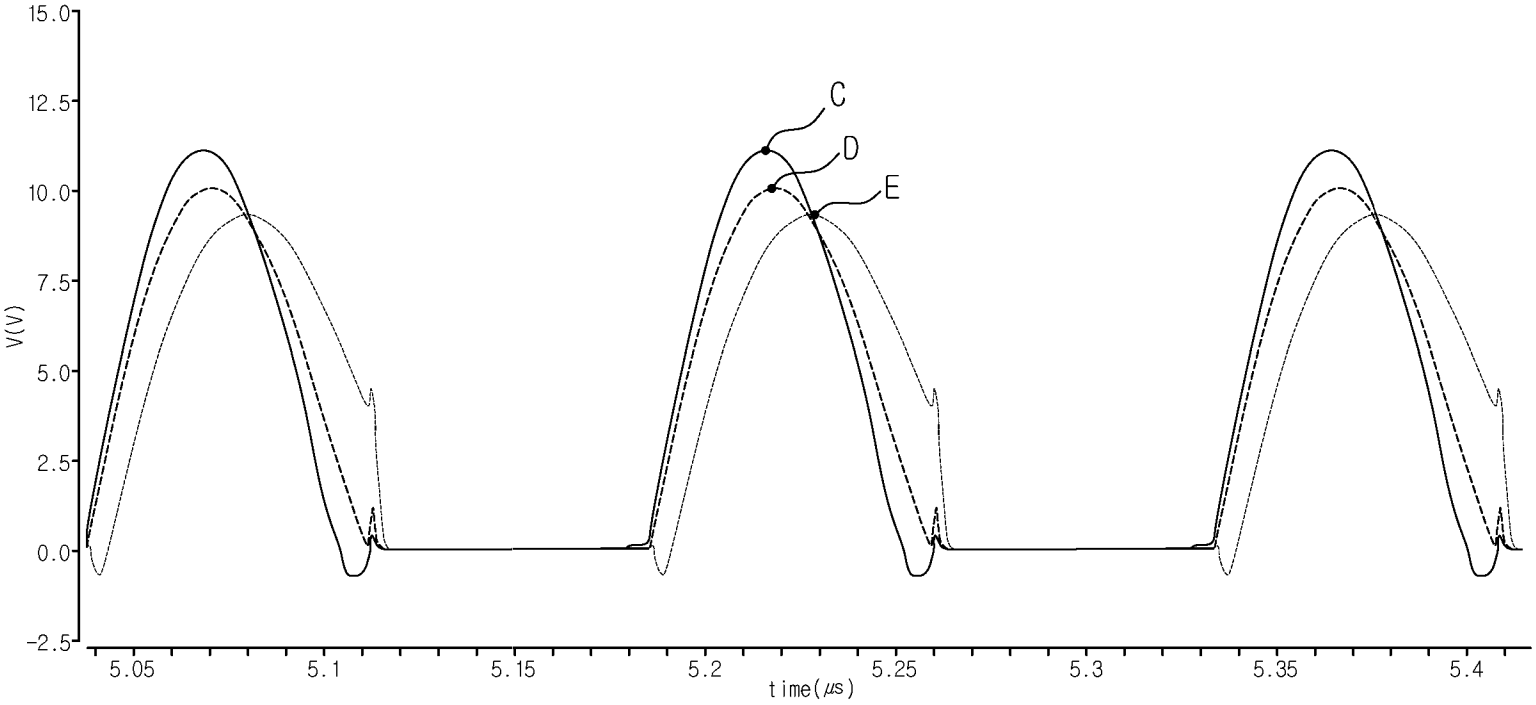
FIG. 10 is a diagram illustrating simulation results of a change in peak voltage of an LC resonant network according to a change in load resistances (approximately 2Ω, 1Ω, and 0.5Ω, respectively) when the current mode class-D power amplifier operates at approximately 6.78 MHz in one or more embodiments of the present disclosure.

FIG. 10 is a diagram illustrating simulation results of a change in peak voltage of an LC resonant network according to a change in load resistances (approximately 2Ω, 1Ω, and 0.5Ω, respectively) when the current mode class-D power amplifier operates at approximately 6.78 MHz in one or more embodiments of the present disclosure. In FIG. 10, the measured values of the peak point C are approximately 5.21534 μs and approximately 11.15368 V, the measured values of the peak point D are approximately 5.217782 μs and approximately 10.11192 V, and the measured values of the peak point E are approximately 5.228352 μs and approximately 9.385039 V.

Referring further to FIG. 10, assuming that the reference peak voltage condition is $R_L$=1Ω, when the temperature of the heat-generating body 40 continues to rise due to electromagnetic induction, the resistance value increases and $V_{LC}$ is sensed in the form of decreasing. In this case, the MCU 24 may stop the operation of the power amplifier 30 in order to lower the temperature of the heat-generating body 40. In contrast, when the power amplifier 30 stops operating for a certain period of time and the temperature of the heat-generating body 40 decreases, $V_{LC}$ is detected in the form of rising again, and at this time, the MCU 24 may operate the power amplifier again to maintain the temperature of the heat-generating body constant. Although the numerical value of the load resistor and the change amount of VLC have been described as a non-limiting example in the above, it is clear that this is an example and is not limited to specific implementation examples. For example, for ease of operation of the sensing circuit 22, the $V_{LC}$ may be connected to the sensing circuit 22 through a normal peak detector circuit using a diode or operation amplifier among peak detectors.

In the electromagnetic induction heating apparatus implemented through the present disclosure, a combination of the apparent resistance value estimation and LC resonance voltage sensing described above may also be used in order to actively sense the temperature of the heat-generating body 40 and determine whether or not the power amplifier 30 operates in response thereto. The performance of such an operation can be selectively controlled by the MCU 24 constituting the driving unit 20, and can immediately control the operation time and time point of the power amplifier 30 with respect to the change in temperature of the heat-generating body 40 that occurs when a user repeats an act of inhaling an electronic smoking article using the heat-generating body 40 so that the heat-generating body 40 for forming aerosol always maintains an optimal heating temperature.

According to the present disclosure, there is an effect of providing an electromagnetic induction heating apparatus for heating an aerosol-forming article of an electronic cigarette, which can maximize a power utilization factor in a process of heating the aerosol-forming article of the electronic cigarette using a heat-generating body, can reduce the implementation and manufacturing difficulty of the apparatus, and can adaptively control a heating temperature of the heat-generating body.

Although the electromagnetic induction heating apparatus for heating the aerosol-forming article of the electronic cigarette has been described with reference to the specific embodiments, it is not limited thereto. Therefore, it will be readily understood by those skilled in the art that various modifications and changes can be made thereto without departing from the spirit and scope of the present disclosure defined by the appended claims.

What is claimed is:

1. An electromagnetic induction heating apparatus for heating an aerosol-forming article of an electronic cigarette, comprising:

a power supply unit configured to supply DC power;

a power amplifier including:

a switch unit composed of a pair of transistor switches having a differential structure and operating by receiving the DC power from the power supply unit, and a LC resonant network composed of a resonant inductor connected to an output terminal of the switch unit and electromagnetically inductively coupled with an inductor component of a heat-generating body for heating the aerosol-forming article of the electronic cigarette and a resonant capacitor connected in parallel to the resonant inductor; and a driving unit configured to adjust an operation of the power amplifier to adjust a temperature of the heat-generating body.

2. The electromagnetic induction heating apparatus of claim 1, wherein the power amplifier is a current mode class-D power amplifier, and the switch unit constituting the power amplifier is configured to induce resonance of the LC resonant network to transfer power to the heat-generating body.

3. The electromagnetic induction heating apparatus of claim 1, wherein the power amplifier further includes a first choke inductor installed between a drain of a first transistor switch constituting the switch unit and the power supply unit and a second choke inductor installed between a drain of a second transistor switch constituting the switch unit and the power supply unit, and the LC resonant network is connected to the drain of the first transistor switch and the drain of the second transistor switch.

4. The electromagnetic induction heating apparatus of claim 1, wherein the driving unit is configured to estimate a change in temperature of the heat-generating body by calculating a change in resistance value of the heat-generating body according to a voltage of the LC resonant network, and control the operation of the power amplifier according to the estimated change in temperature.

5. The electromagnetic induction heating apparatus of claim 1, wherein the driving unit includes:

a sensing circuit configured to sense a voltage of the LC resonant network, an MCU configured to estimate a change in temperature of the heat-generating body by calculating a change in resistance value of the heat-generating body according to the voltage of the LC resonant network sensed by the sensing circuit and generate a heat-generating body temperature control signal for controlling a temperature of the heat-generating body according to the estimated change in temperature of the heat-generating body, and a switch driver configured to generate a switch driving signal for differentially driving the pair of transistor switches constituting the switch unit according to the heat-generating body temperature control signal received from the MCU.

6. The electromagnetic induction heating apparatus of claim 1, wherein the driving unit is configured to calculate a change in resistance value of the heat-generating body according to a current used by the power amplifier and control the operation of the power amplifier according to the calculated change in resistance value.

7. The electromagnetic induction heating apparatus of claim 1, wherein the driving unit includes:

a sensing circuit configured to sense a current used by the power amplifier, an MCU configured to calculate a change in resistance value of the heat-generating body according to the current used by the power amplifier sensed by the sensing circuit and generate a heat-generating body temperature control signal for controlling a temperature of the heat-generating body according to the calculated change in resistance value of the heat-generating body, and a switch driver configured to generate a switch driving signal for differentially driving the pair of transistor switches constituting the switch unit according to the heat-generating body temperature control signal received from the MCU.

8. The electromagnetic induction heating apparatus of claim 1, wherein an operating frequency of the pair of transistor switches constituting the switch unit is approximately 0.1 MHz to approximately 27.283 MHz.

9. The electromagnetic induction heating apparatus of claim 1, wherein the power supply unit includes a rechargeable DC battery.

* * * * *